US006284064B1

(12) United States Patent
Fujiwara et al.

(10) Patent No.: US 6,284,064 B1
(45) Date of Patent: Sep. 4, 2001

(54) CARBON STEEL MATERIAL AND PROCESSING METHOD FOR STRENGTHENING THE SAME

(75) Inventors: Akira Fujiwara; Atsushi Shirakawa; Kazushige Yakubo, all of Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/546,974

(22) Filed: Apr. 11, 2000

(30) Foreign Application Priority Data

Apr. 13, 1999 (JP) ..... 11-105846
Mar. 30, 2000 (JP) ..... 12-093864

(51) Int. Cl.[7] ..... C21D 7/00; C21D 8/00; C22C 38/22; C22C 38/24

(52) U.S. Cl. ..... 148/320; 148/333; 148/334; 148/335; 148/645; 148/663

(58) Field of Search ..... 148/645, 320, 148/333, 334, 335, 663

(56) References Cited

U.S. PATENT DOCUMENTS 5,284,534 * 2/1994 Mendes ..... 148/645
5,709,759 * 1/1998 Ljungars et al. ..... 148/645

* cited by examiner

*Primary Examiner*—Deborah Yee
(74) *Attorney, Agent, or Firm*—Arent Fox Kintner Plotkin & Kahn, PLLC

(57) ABSTRACT

In a processing method for strengthening carbon steel materials, a carbon steel having an average hardness in the range of HRC 50 to 57 and a bainite structure is subjected to a tension working so as to provide a residual strain of at least 0.3% to the carbon steel. The tensile load in the tension working exceeds the yield point, and is 95% or less of the fracture load.

10 Claims, 10 Drawing Sheets

Sample A (Tempering Temperature:260℃)

Sample B (Tempering Temperature:280℃)

Sample C (Tempering Temperature:320℃)

Sample D (Tempering Temperature:340℃)

☆ Initial Yield Point

☆ Yield Point after Processing for Yield Point

☆ Initial Yield Point

☆ Yield Point after Processing for Yield Point

CARBON STEEL MATERIAL AND PROCESSING METHOD FOR STRENGTHENING THE SAME

BACKGROUND OF THE INVENTION

1. Technical Field

The present invention relates to a processing method for strengthening materials such as thin plates and rods made of carbon steel, and specifically relates to a strengthening process for improving fatigue strength.

2. Background Arts

Until recently, it had been believed that the fatigue strength of mechanical parts, specifically in carbon steel materials used for parts in automobiles, among mechanical properties of the materials, greatly depends on tensile strength. Therefore, fatigue limits such as the number of repeated rotating and bending cycles, the number of repeated tensioning and compressing cycles, the number of repeated twisting cycles, and the like have been evaluated based on tensile strength. However, it is well seen that even if tensile strength is improved, fatigue strength cannot be easily improved, or there may be a region with no improvement in fatigue strength. Therefore, in order to improve fatigue strength, methods for hardening surfaces of materials by providing residual compressive stress thereto through several types of plastic processing, such as rolling, form rolling, drawing, and shot-peening have been generally applied.

However, in a method such as the above in which fatigue strength is improved, although fatigue properties of a material can be somewhat improved, fatigue strength of the overall material could not be improved. As a result, a portion with low fatigue strength may be the initiation site of a fracture, and this readily results in premature failure. Furthermore, in a shot-peening processing, a number of conditions such as shot diameter, incident speed, frequency of shot-peening processing (number of steps), and shot washing vary for each type of material, so that extensive experimentation was required to determine the optimal conditions for a specific case. The compressing processing such as rolling, form rolling, and drawing similarly require extensive experimentation to select processing conditions.

SUMMARY OF THE INVENTION

Therefore, an object of the present invention is to provide a processing method for strengthening carbon steel materials, which can relatively easily improve the fatigue strength of the overall material.

The inventors have intensively researched the phenomena in the region in which there is no improvement in fatigue strength even if tensile strength is improved. As a result, the inventors have discovered that fatigue strength is more closely related to yield point in measuring tensile strength than tensile strength. That is, when the tensile load is removed after increasing to an optional load which exceeds the yield point and is lower than the fracture load, and is then again increased, the yield point increases approximately up to the previous tensile load (the load just before the removal thereof). The increase in the yield point is due to the residual strain (residual tensile stress) provided to the entire material. Thus, the fatigue strength of the material with residual strain is improved. The inventors have discovered that a carbon steel having an average Rockwell hardness on the C scale (hereinafter referred to as "HRC") in the range of 50 to 57 and a bainite structure is a material to which residual strain can easily be provided, and that one having a residual strain of at least 0.3% is effective for significantly improving fatigue strength. The present invention is made based on such knowledge. The invention provides a processing method for strengthening carbon steel materials, the method comprises performing a tension working to a carbon steel material having an average hardness in the range of HRC 50 to 57 and a bainite structure so as to provide a residual strain of at least 0.3%. It should be noted that the yield point refers to a stress at which plastic deformation of the material can be clearly observed to some extent, and the yield point includes the stress at which a predetermined stress, 0.2%, occurs, namely it includes proof stress at 0.2%.

The reason for limiting the average hardness is described below. When the average hardness is less than HRC 50, the fracture load is low and sufficient tensile load cannot be exerted on the material beyond the yield point. As a result, residual strain cannot be provided and improvement in fatigue strength cannot be expected. In contrast, when the average hardness is more than HRC 57, a martensite structure and a austenite structure may extensively precipitate in a bainite structure. When a tensile load is exerted on the structure, the residual austenite may be transformed into induced martensite, and the entire material may be hard and brittle. As a result, the material may be extended only up to a certain point, at which its ability to extend suddenly decreases, and elongation at a tensile load range above the yield point may be difficult to obtain. Therefore, an increase in the yield point may not be expected, and improvement in fatigue strength may not be expected. Carbon steels generally include four structures which are a ferrite structure, a pearlite structure, a martensite structure, and a bainite structure. Among these structures, the ferrite structure and the pearlite structure are soft, so that sufficient residual strain cannot be provided even if a tensile load is exerted thereon. The martensite structure is not suitable since it is hard and brittle, as mentioned above. In contrast, the bainite structure has good ductility, and sufficient residual strain may be provided thereon by exerting a tensile load.

In the invention, a material is subjected to a tensile working instead of compressing working as in conventional methods, so that residual strain, which is a positive residual stress, is provided to the material. FIG. 1 shows a stress-strain diagram. When the tensile load is removed after increasing from $A_0$ and exceeding the yield point $B_0$ to $B_1$, the strain does not return to $A_0$, but returns along the line $B_1$ to $A_1$, so that the strain corresponding to $A_0$ to $A_1$ remains in the material. The amount of the strain is a residual strain provided by the tension working and contributes to hardening of the entire material and to improving fatigue strength thereof. The size of the tensile load exerted again on the material after removing the load is chosen from the range exceeding the yield point and less than the fracture load, in which the entire material is evenly elongated. The size of the load is preferably 95% or less of the fracture load to avoid large deformation. The residual strain provided to the material by tension working is 0.3% or more, and is preferably 1.0% or more.

There were disadvantages in that surfaces of materials may be damaged and roughened in compressing working, but the invention is free from such disadvantages since a tension working is performed instead. Moreover, only a tensile load for providing residual strain needs to be set as a condition for improving fatigue strength, and is obtained by measuring a yield point and a fracture load through a tensile test. Therefore, the amount of experimentation to conditions can be remarkably small, and the process for improving fatigue strength can be efficient.

The chemical composition of the carbon steel material may be, for example, 0.5 to 0.65 weight % of C; 0.1 to 1.5 weight % of Si; 0.5 to 1.2 weight % of Mn; 0.5 to 0.8 weight % of Cr; no more than 0.15 weight % of Mo; no more than 0.5 weight % of V; no more than 0.2 weight % of Ni; and the balance of Fe. The carbon steel may be subjected to a heat treatment such as martempering in which the carbon steel is quenched from, for example, 880° C. to a temperature just above the Ms point and maintained at that temperature so as to cause isothermal transformation. By such a treatment, a carbon steel having an average hardness in the range of HRC 50 to 57 and a bainite structure as a main structure can be obtained. The carbon steel having such characteristics is subsequently subjected to the aforementioned tension working, so that fatigue strength can be improved over the entire material.

DETAILED DESCRIPTION OF THE INVENTION

The advantages of the invention will be clear from the examples hereinafter.

EXAMPLE 1

Relationship between providing residual strain and fatigue strength (in the same composition)

Figure 1:
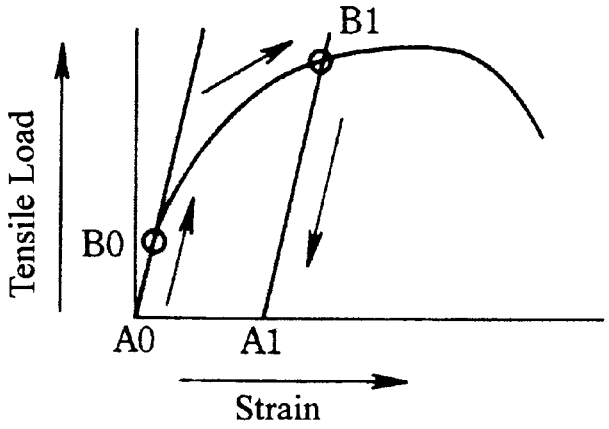
FIG. 1 is a stress-strain curve for explaining residual strain provided to a carbon steel by tension working.
Figure 2:
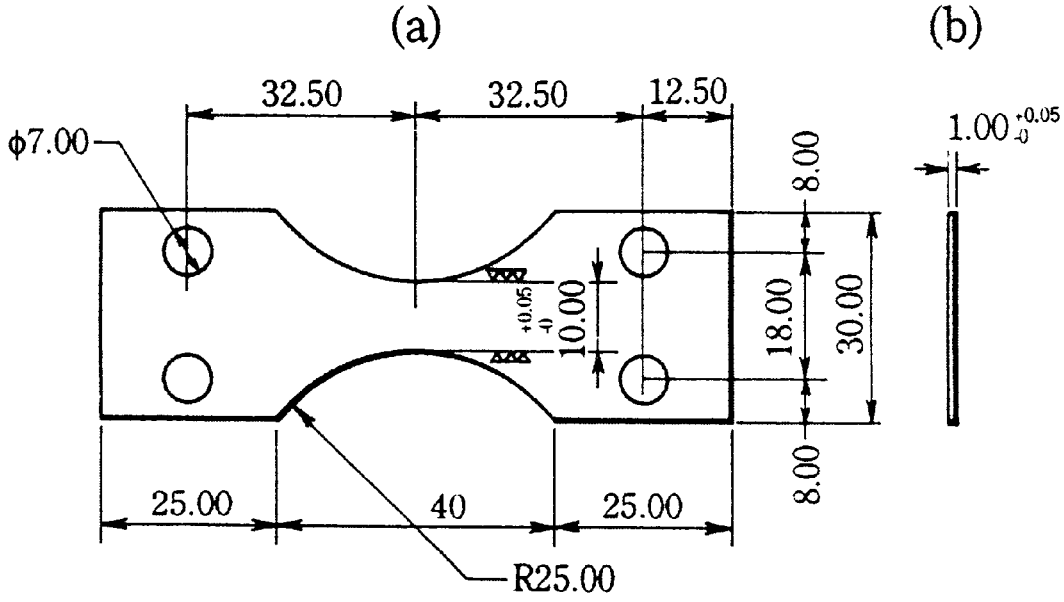
FIG. 2A is a front view of a test piece used in Example 1 according to the invention.
FIG. 2B is a plan view of the test piece.

The necessary number of test pieces shown in FIG. 2 for tension tests was produced from a carbon steel having a chemical composition shown in Table 1. The test piece for the tension test corresponded to the Method of Plane Bending Fatigue Testing (Japanese Industrial Standard No. Z 2275). The test pieces were subjected to martempering in which the test pieces were heated at a tempering temperature for an hour after quenching from the temperature of 880° C.

TABLE 1

(Unit: Weight %)

| C | Si | Mn | P | S | Cu |
|---|---|---|---|---|---|
| 0.54 | 1.48 | 0.78 | 0.06 | 0.004 | 0.15 |
| **Ni** | **Cr** | **Mo** | **S-B** | **Ti** | **S-Al** |
| 0.15 | 0.7 | <0.01 | 0.0015 | 0.038 | 0.02 |

Figure 3A:
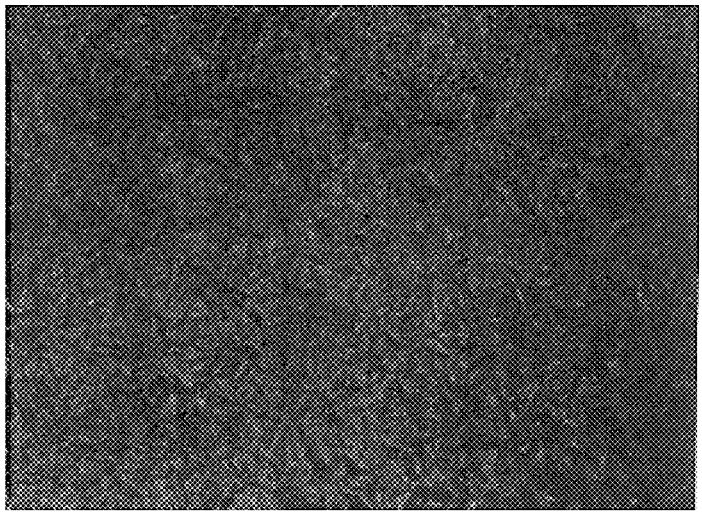
FIG. 3A and FIG. 3B are photomicrographs showing structures of samples A and B in Example 1.
Figure 3B:
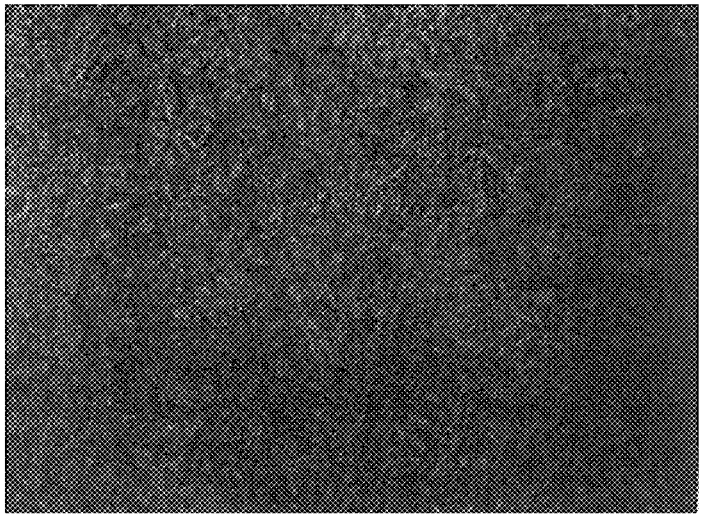
Figure 4A:
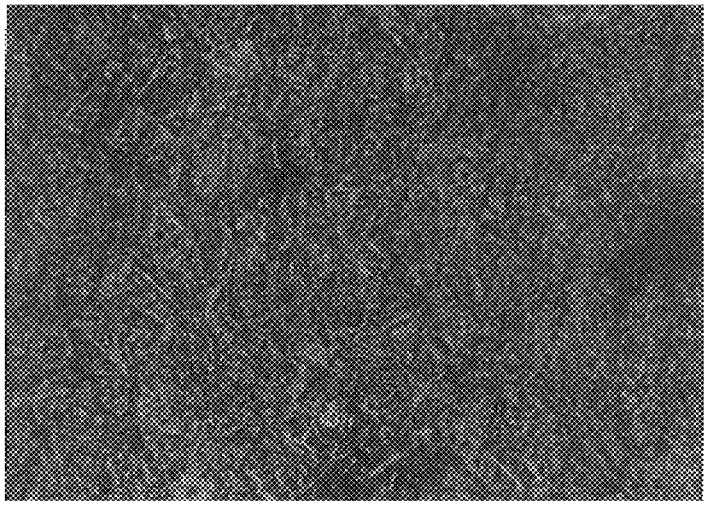
FIG. 4C and FIG. 4B are photomicrographs showing structures of samples C and D in Example 1.
Figure 4B:
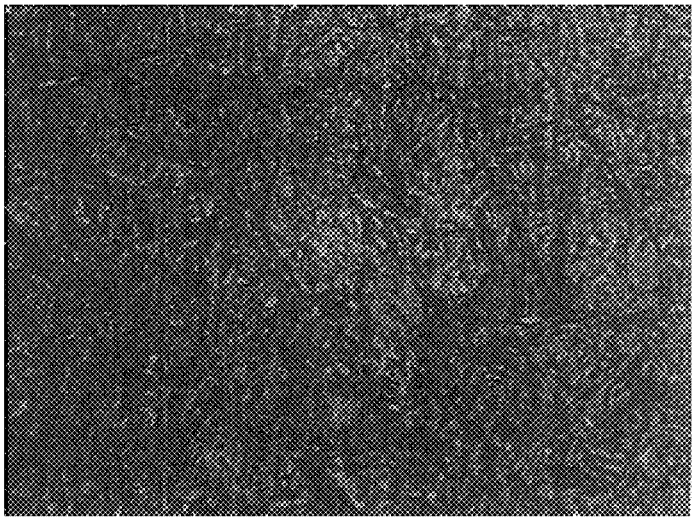
Figure 5A:
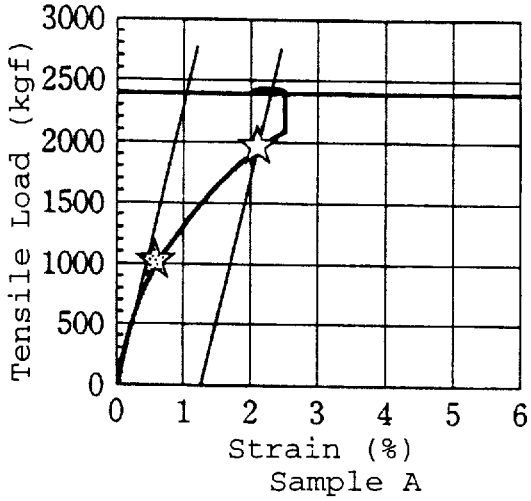
FIG. 5A to 5D are stress-strain curves obtained by a tension working to each sample in Example 1.
Figure 5B:
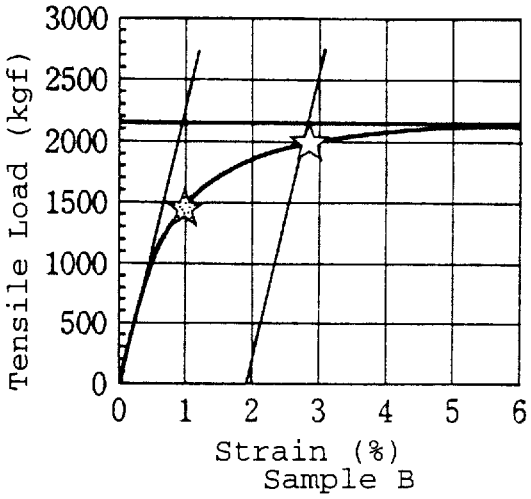
Figure 5C:
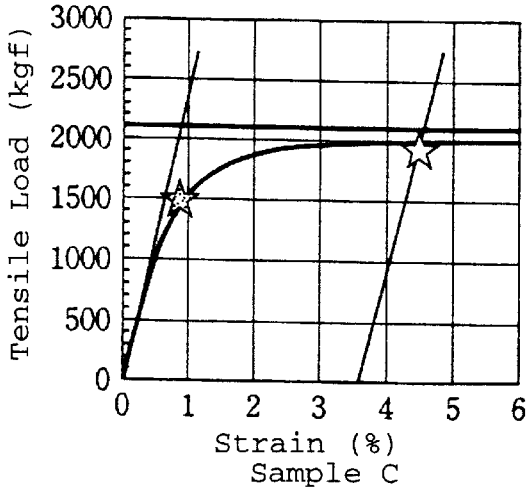
Figure 5D:
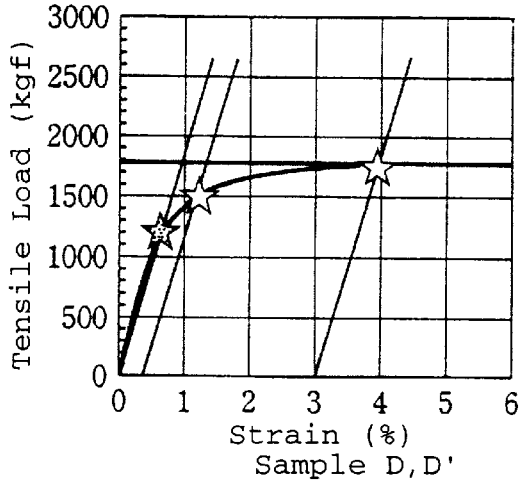

The tempering temperature was individually set for each sample at 260° C. for sample A, 280° C. for sample B, 320° C. for sample C, and 340° C. for sample D, so that four kinds of samples A to D with different tempering temperatures were obtained. The structures of the samples A to D were observed and the hardnesses thereof were measured. FIGS. 3A and 3B are photomicrographs of the samples A and B, and FIGS. 4A and 4B are photomicrographs of the samples C and D. It was observed that each sample had an acicular bainite structure.

Then, the samples A to D were subjected to two kinds of tension tests. In one tension test, the tensile load was increased to above the yield point and was then removed before fracture of the sample (that is, the yield point was increased) so as to provide residual strain; tensile load was again increased, and the increased yield point was measured. This test is hereinafter referred as the "tension test with processing for yield point". In another tension test, the tension load was evenly increased until the sample fractured, and the yield point and the fracture load were measured. This test is hereinafter referred as the "tension test without processing for yield point". One kind of tensile load for providing the residual strain in the tension tests with processing for increasing in yield point was set for the samples A to C, and two kinds of tensile loads were set for the sample D (D and D'). Residual strains and hardness of the samples A to D' provided with residual strain were measured. Strain-stress curves in the above tension tests are shown in FIGS. 5A to 5D, and fatigue strengths calculated from the results of the tests and the yield points are shown in Table 2. It should be noted that the proportion of yield point is the proportion of the yield load with respect to the fracture load in the case of non-processing for yield point. The data in FIG. 5 and Table 2 are averages of five samples of each type of test piece.

TABLE 2

| | Heat Treatment | | Result of Tension Test | | Result of Processing for Yield Point | | | | | |
|---|---|---|---|---|---|---|---|---|---|---|
| | Quenching Temperature ° C. | Tempering Temperature ° C. | Fracture Load kgf | Tension Strength Kgf/mm$^2$ | Load kgf | Yield Point Kgf/mm$^2$ | Proportion of Yield Point % | Residual Strain % | Hardness HRC | Fatigue Strength Kgf/mm$^2$ |
| A | 880 | 260 | 2405 | 240.5 | 1100 | 110 | 45.74 | 0 | 54 | 38 |
| A* | | | — | — | 2000 | 200 | 83.16 | 1.299 | 55 | 72 |
| B | 880 | 280 | 2169 | 216.9 | 1420 | 142 | 65.47 | 0 | 52 | 44.5 |
| B* | | | — | — | 2000 | 200 | 92.21 | 1.975 | 53 | 69 |
| C | 880 | 320 | 2076 | 207.6 | 1500 | 150 | 72.2 | 0 | 52 | 45.9 |
| C* | | | — | — | 2000 | 200 | 96.34 | 3.566 | 53 | 68 |
| D | 880 | 340 | 1837 | 183.7 | 1150 | 115 | 62.6 | 0 | 51 | 34.8 |
| D* | | | — | — | 1500 | 150 | 81.65 | 0.378 | 51 | 54 |
| D'* | | | — | — | 1800 | 180 | 96 | 3.000 | 51 | 62 |

*With Processing for Yield Point

Figure 6:
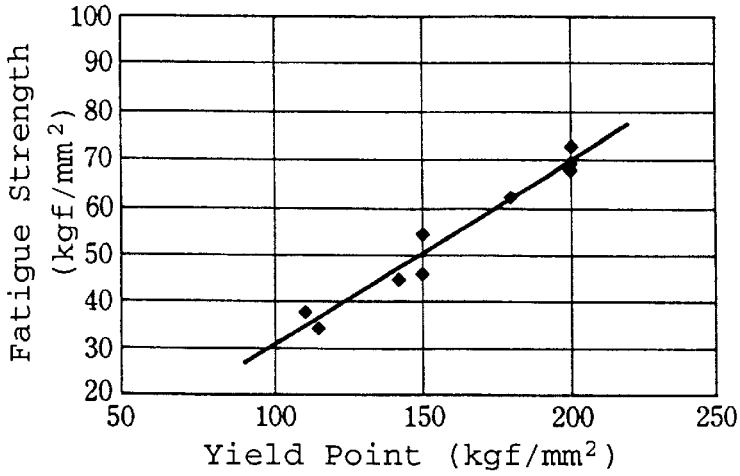
FIG. 6 is a diagram showing the relationship between yield point and fracture strength of each sample in Example 1.
Figure 7:
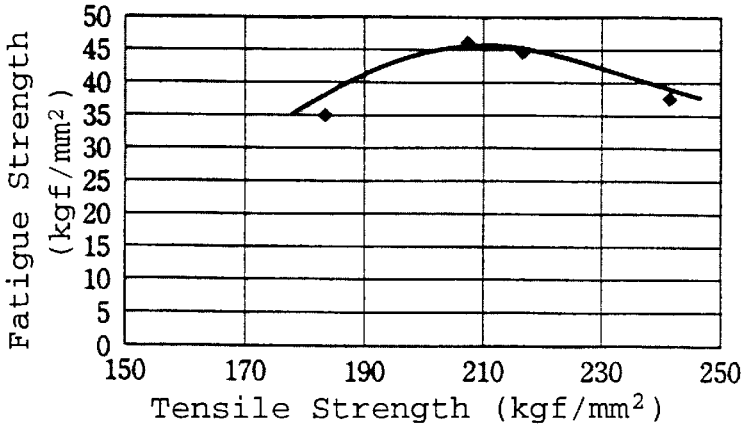
FIG. 7 is a diagram showing the relationship between tensile strength and fracture strength of each sample without processing for yield point in Example 1.
Figure 8:
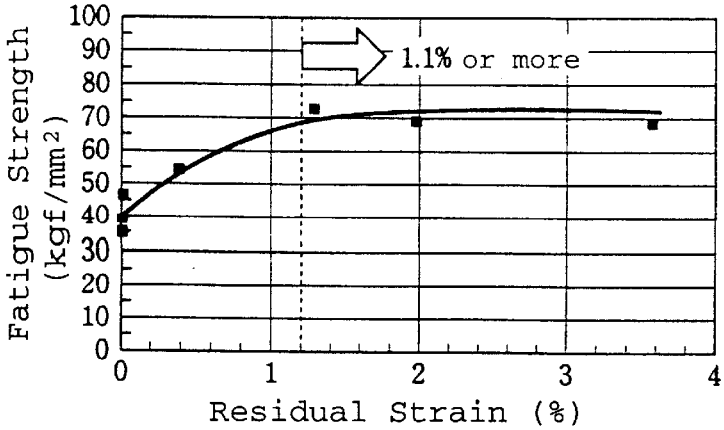
FIG. 8 is a diagram showing the relationship between residual strain and fracture strength of each sample with processing for yield point in Example 1.
Figure 9:
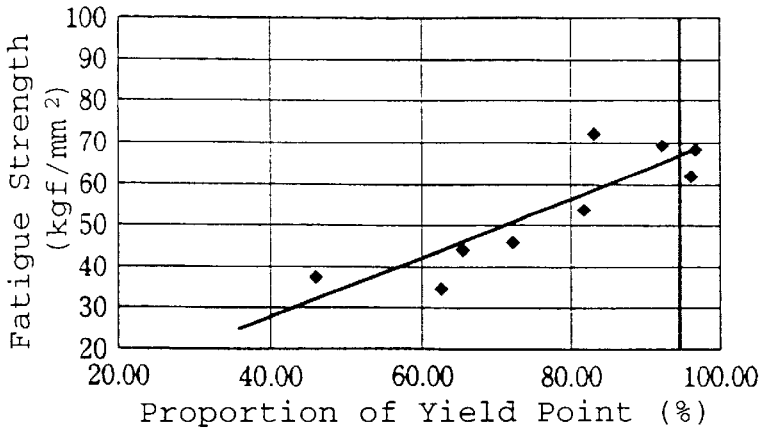
FIG. 9 is a diagram showing the relationship between a proportion of yield point and fracture strength of each sample in Example 1.

According to Table 2, in each of the cases of samples A to D', it is seen that fatigue strengths in the cases with processing for yield point are improved compared with in the cases without processing for yield point. The relationship between yield point and fatigue strength is shown in FIG. 6, the relationship between tensile strength and fatigue strength is shown in FIG. 7. As shown in FIG. 6, it is seen that the fatigue strength is improved in proportion to increase in the yield point. As shown in FIG. 7, it is seen that the fatigue strength is not always improved even if the tensile strength is improved, and a mutual relationship therebetween cannot be found. FIG. 8 shows the relationship between residual strain and fatigue strength. According to FIG. 8, the fatigue strength is stable below the maximum value of 70 kgf/m$^2$, and it is seen that fatigue strength can be reliably provided when the residual strain is at least 1.1%. However, fatigue strength is improved when the residual strain is 0.3% or more, and it is therefore determined that the residual strain is 0.3% or more, and is preferably 1.0% or more, and is more preferably 1.1% or more. FIG. 9 shows the-relationship between the proportion of yield point and the fatigue strength in all the samples with and without processing for yield point, and it is seen that the fatigue strength increases as the proportion of yield point increases. It is determined that the proportion of yield point is 97% or less, which is below the fracture load of the material (100% of the proportion of yield point) and in which large deformation does not occur, and is preferably 97% or less.

EXAMPLE 2

Relationship between Processing for Yield Point and Fatigue Strength

Test pieces shown in FIG. 2 corresponding to the Method of Plane Bending Fatigue Testing (Japanese Industrial Standard no. Z 2275) were produced from carbon steels with chemical compositions as shown in Table 3. The test pieces were subjected to martempering, as mentioned above, in which they were quenched from 880° C. and heated at tempering temperatures shown in Table 3, so that samples E1 to E11 having various chemical compositions. Hardnesses of the samples E1 to E11 were measured, and the samples were then subjected to simple tension tests without processing for yield point and tension tests with processing for yield point to provide residual strain. The tensile loads in the tension tests with processing for yield point, namely which were the proportions of yield points, were equal to 95% of the fracture loads in the tension tests without processing for yield point. Hardness after the martempering, tensile strength, yield point and elongation in the tension test without processing for yield point, and fatigue strength in the tension test, with or without the processing for yield point with respect to the samples E1 to E11, are shown in Table 3. The data in Table 3 is an average of five samples of each type of test piece.

TABLE 3

| Composition wt % | E1 | E2 | E3 | E4 | E5 | E6 | E7 | E8 | E9 | E10 | E11 |
|---|---|---|---|---|---|---|---|---|---|---|---|
| C | 0.47~0.55 | 0.54 | 0.5 | 0.55 | 0.6 | 0.55 | 0.65 | 0.7 | 0.55 | 0.55 | 0.55 |
| Si | 0.1~0.2 | 1.48 | ← | 1.48 | ← | 0.1~0.2 | 1.5 | 1.5 | 1.5 | 1.5 | 1.5 |
| Mn | 1.20~1.50 | 0.78 | ← | 0.78 | ← | 0.78 | 0.78 | 0.78 | 0.78 | 0.78 | 0.78 |
| P | <0.03 | 0.006 | ← | 0.006 | ← | <0.01 | <0.01 | <0.01 | <0.01 | <0.01 | <0.01 |
| S | <0.05 | 0.004 | ← | 0.004 | ← | <0.01 | <0.01 | <0.01 | <0.01 | <0.01 | <0.01 |
| Cu | | | | | | | | | | | |
| Ni | | | | | | | | 0.2 | | | |
| Cr | | 0.7 | ← | 0.7 | ← | 0.7 | 0.7 | 0.7 | 0.7 | 0.7 | 0.55 |
| Mo | | <0.01 | | <0.01 | | <0.01 | <0.01 | <0.01 | <0.01 | 0.15 | <0.01 |
| S-B | 0.0005~ 0.003 | 0.0015 | ← | 0.0015 | ← | 0.0005 MIN | 0.0005 MIN | 0.0005 MIN | 0.0005 MIN | 0.0005 MIN | 0.0005 MIN |
| Ti | | 0.038 | ← | 0.038 | ← | | | | | | |
| V | | | | | | | | | | | 0.5 |
| Nb | | | | | | | | | | | |
| S—Al | | 0.02 | ← | 0.02 | ← | | | | | | |
| Tempering Temperature ° C. | 290 | 260 | 260 | 260 | 260 | 260 | 260 | 260 | 260 | 260 | 260 |
| Tensile Strength kgf/mm$^2$ | 180.4 | 202 | 190 | 202 | 215 | 190 | 220 | 170 | 215 | 215 | 220 |

TABLE 3-continued

| Composition wt % | | E1 | E2 | E3 | E4 | E5 | E6 | E7 | E8 | E9 | E10 | E11 |
|---|---|---|---|---|---|---|---|---|---|---|---|---|
| Yield Point kgf/mm$^2$ | | 149 | 140 | 140 | 140 | 150 | 170 | 150 | 150 | 150 | 150 | 170 |
| Elongation % | | 13.7 | 16 | 18 | 16 | 14 | 12 | 8 | 3 | 10 | 10 | 8 |
| Hardness HRC | | 51.6 | 55.5 | 53 | 55.5 | 56 | 52 | 57 | 58 | 55 | 55.5 | 55.5 |
| Fatigue Strength kgf/mm$^2$ | Without Processing for Yield Point | 50 | 46 | 46 | 46 | 50 | 57.8 | 50 | 50 | 50 | 50 | 57.8 |
| | With Processing for Yield Point | 55 | 66 | 62 | 66 | 73 | 61.9 | 73 | 55 | 71 | 70 | 73 |

As is clearly shown in Table 3, each of the cases of samples E1 to E11, it was confirmed that the fatigue strengths in the tension tests with processing for yield point were improved, and that the fatigue strength would be sufficient when the proportions of yield points were 95% of the fracture loads in comparison with those in the tension tests without processing for yield point.

EXAMPLE 3

Improvement of Fatigue Strength in a Chain

An example in which the invention is applied to improve fatigue strength in chains will be explained hereinafter. In the example, a chain, which is manufactured by arranging at least a pair of links in parallel and endlessly connecting a plurality of the pairs of links via pins or rollers, is stretched along the connection thereof, so that residual strain is provided to all the links evenly to improve fatigue strength of the all of the links.

Figure 10:
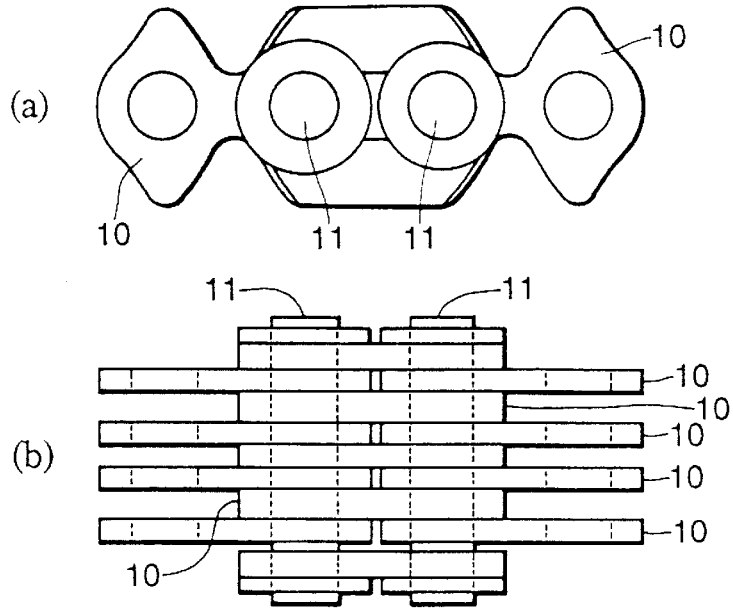
In FIG. 10, (*a*) is a side view showing the structure of a chain which is a necessary material for improving fatigue strength in Example 3, and (*b*) is a plan view of the chain.
Figure 11:
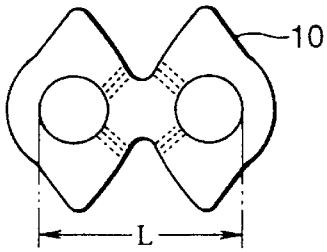
FIG. 11 is a side view of a link which is part of the chain in Example 3.
Figure 12:
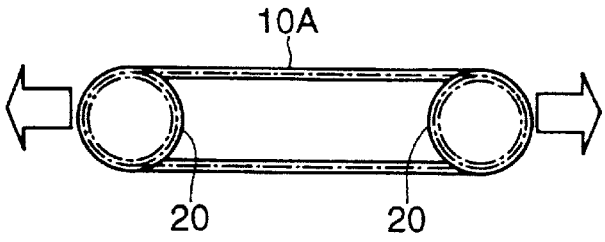
FIG. 12 is a side view showing a method for providing a pre-stretch to the chain in Example 3.

FIG. 10 shows a construction of a chain with multiple row-type links, which is suitable, for example, for timing chains for transmitting rotation of a crankshaft to a cam sprocket in automobile engines. The chain is manufactured by endlessly connecting a plurality of row links 10 arranged in parallel via rollers 11. The links 10 are assembled into a chain after performing a martempering heat treatment. The pitch of link 10 varies due to deformation during the heat treatment in actual use. It should be noted that the pitch is defined as the length L in FIG. 11, which may be determined, for example, to be in the range of 9 to 10 mm. The chain is normally subjected to a preliminal processing, called "pre-stretching", in order to decrease variation in the pitches. As shown in FIG. 12, the pre-stretching is performed such that a chain 10A, manufactured with the links 10, is turned around a pair of sprockets 20 which are moved in the opposite direction so as to tension the chain 10A, so that the pitches of the links 10 become even or nearly so. The dotted portion of the link 10 in FIG. 11 is the portion in which the load is most concentrated by the pre-stretching. The inventors conducted research to determine whether or not residual strain is provided to each link 10 in the pre-stretching. As a result, the tests described below clearly showed that it was difficult to provide the required residual strain to all the links 10 due to variation in the pitches L.

Figure 13:
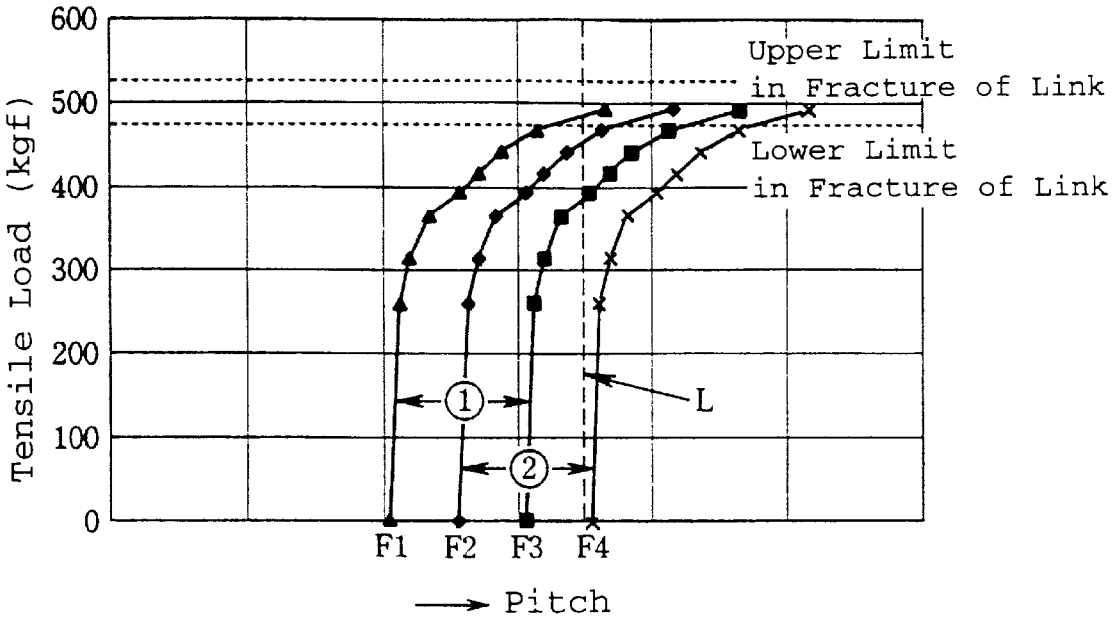
FIG. 13 is a diagram showing a relationship between tensile load and elongation when the link in Example 3 is tensioned without processing for yield point.

That is, samples of links having pitches of (L-0.15 mm) for sample F1, (L-0.1 mm) for sample F2, (L-0.05 mm) for sample F3, and (L±0 mm) for sample F4 with respect to the required pitch L were obtained and were subjected to tension tests. FIG. 13 is a tensile load-elongation curve showing the results of the tests. If two links, in which the difference in the pitches is within 0.1 mm, are arranged in parallel and are subjected to pre-stretching simultaneously, the samples F1 and F3 are matched as indicated by ① in FIG. 13, and the samples F2 and F4 are matched as indicated by ②. In the matching samples F1 and F3, if the sample F3 reaches the yield point, the sample F1 is in the fracture region. That is, if the samples F1 and F3 are simultaneously pre-stretched, residual strain can be provided to the sample F3, but the sample F1 may fracture since the elongation thereof may be in the fracture region. In the matching samples F2 and F4, the sample F4 may be barely extended, even if the sample F2 exceeds the yield point, and residual strain cannot be provided to the sample F4. These phenomena appear when the links are merely tensioned without processing for yield point, and they suggest that residual strain cannot be provided to all the links, even if links are selected so that the difference between pitches is within 0.1 mm.

The inventors conducted research to determine whether or not residual strain can be provided when a chain assembled from links, which had been subjected to the processing for yield point, was pre-stretched. The inventors believe that the entire elongation in this case is greater than that normal tension applied once, and produced samples of links having an average pitch of (L-0.2 mm) or less with respect to the required pitch. In the samples of links, the difference between the pitches was within 0.1 mm, and the pitches were (L-0.27 mm) for the sample G1, (L-0.22 mm) for the sample G2, and (L-0.17 mm) for sample G3.

Figure 14:
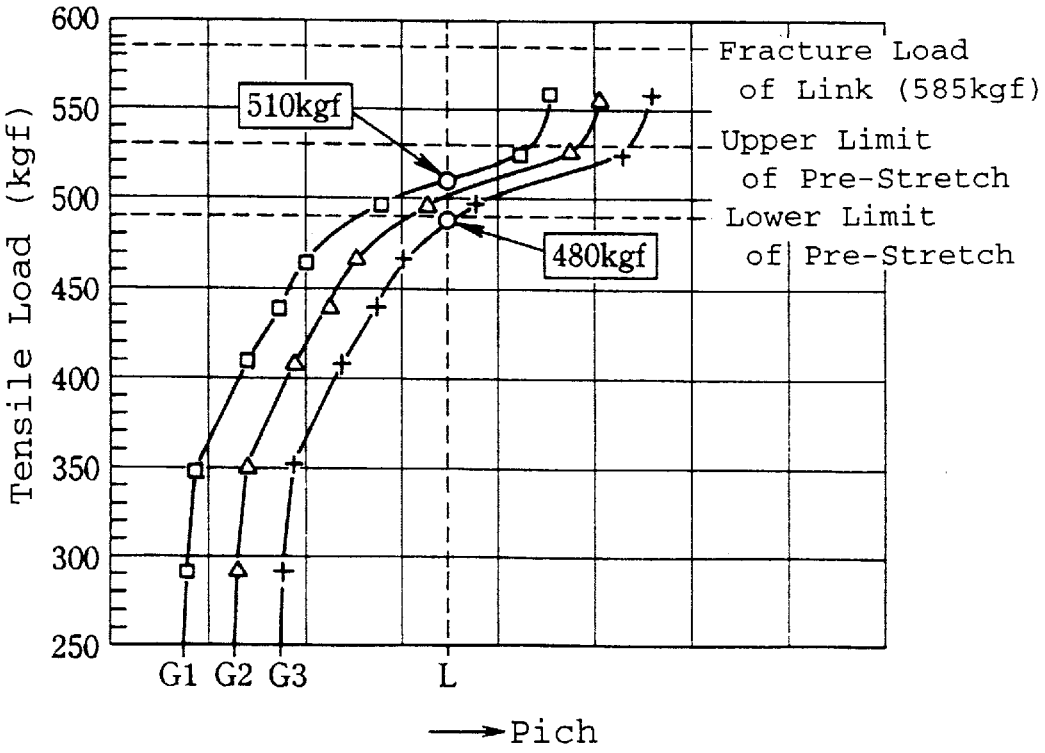
FIG. 14 is a diagram showing a relationship between tensile load and elongation when the link in Example 3 is tensioned with processing for yield point.

These samples were subjected to tension tests without processing for yield point to obtain the fracture loads, and were then subjected to tension tests with processing for yield point. The tensile load was at least 82% of the fracture load. FIG. 14 shows a tensile load-elongation curve. As is clearly shown in FIG. 14, all the links G1, G2, and G3 exceeded the yield point when the pitch thereof reached the desired pitch L, and were maintained in the range in which residual strain can-be provided.

Figure 15:
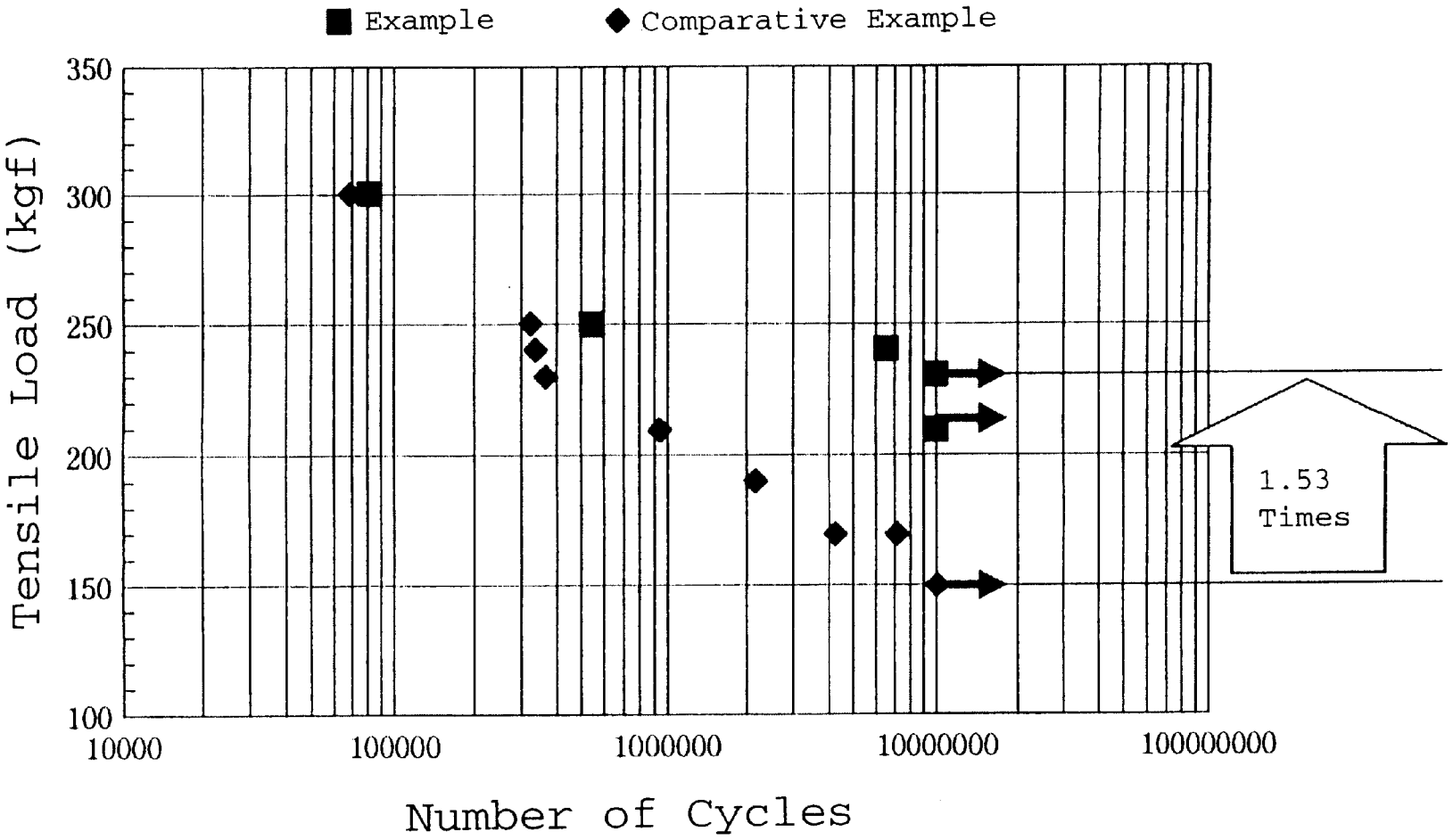
FIG. 15 is a graph showing a result of a cycle test on the chain in Example 3.

Then, a chain of the example assembled from the links G1, G2, and G3 which had been pre-stretched to provide predetermined residual strain thereto, and a chain assembled from links subjected to a heat treatment without tension working, were prepared. The chains were subjected to cycle tests in which predetermined tensile loads were repeatedly applied to the chains and the fatigue strengths were determined based on the number of tension cycles when the links fractured and chains broke. FIG. 15 shows the results of the tests. According to FIG. 15, it is apparent that the chains in the example had high durability compared to the chains in the comparative examples. According to the fracture load when the tension was applied 10 million cycles, it was seen that the examples had fatigue strengths 1.53 times those of the comparative examples.

According to the above tests, the average pitch of the links is preferably a predetermined length (0.2 mm on average in the example) or more shorter than the required pitch, the difference between the pitches is preferably within the predetermined length (0.1 mm in the example), and the links are preferably subjected to tension working with processing for yield point. In this way, the required residual strain can be provided to all the links when the chain is subjected to pre-stretching, and the fatigue strength of all the links, that is, the chain, can be improved.

What is claimed is:

1. A processing method for strengthening carbon steel materials, the method comprises performing a tension working to a carbon steel material having an average hardness in the range of HRC 50 to 57 and a bainite structure so as to provide a residual strain of at least 0.3%.

2. A processing method for strengthening carbon steel materials according to claim 1, wherein the size of a load for providing the residual strain is 95% or less of a fracture load of the materials.

3. A processing method for strengthening carbon steel materials according to claim 1, wherein the residual strain is 1.0% or more.

4. A processing method for strengthening carbon steel materials according to claim 1, wherein the carbon steel material comprises 0.5 to 0.65 weight % of C; 0.1 to 1.5 weight % of Si; 0.5 to 1.2 weight % of Mn; 0.5 to 0.8 weight % of Cr; no more than 0.15 weight % of Mo; no more than 0.5 weight % of V; no more than 0.2 weight % of Ni; and the balance of Fe.

5. A processing method for strengthening carbon steel materials according to claim 1, wherein the carbon steel is subjected to a martempering in which the carbon steel is quenched from 880° C. to a temperature just above the Ms point and maintained at that temperature so as to cause isothermal transformation.

6. A carbon steel material produced by performing a tension working to a carbon steel having an average hardness in the range of HRC 50 to 57 and a bainite structure so as to provide a residual strain of at least 0.3%.

7. A carbon steel material according to claim 6, wherein the size of a load for providing the residual strain is 95% or less of a fracture load of the carbon steel.

8. A carbon steel material according to claim 6, wherein the residual strain is 1.0% or more.

9. A carbon steel material according to claim 6, wherein the carbon steel material comprises 0.5 to 0.65 weight % of C; 0.1 to 1.5 weight % of Si; 0.5 to 1.2 weight % of Mn; 0.5 to 0.8 weight % of Cr; no more than 0.15 weight % of Mo; no more than 0.5 weight % of V; no more than 0.2 weight % of Ni; and the balance of Fe.

10. A carbon steel material according to claim 6, wherein the carbon steel is subjected to a martempering in which the carbon steel is quenched from 880° C. to a temperature just above the Ms point and maintained at that temperature so as to cause isothermal transformation.

* * * * *